United States Patent [19]

Dahlin

[11] Patent Number: 4,566,243

[45] Date of Patent: Jan. 28, 1986

[54] PLANK GRATING ASSEMBLY

[75] Inventor: Robert D. Dahlin, Hillsborough County, Fla.

[73] Assignee: Benchcraft, Inc., Brentwood, Mo.

[21] Appl. No.: 673,861

[22] Filed: Nov. 21, 1984

Related U.S. Application Data

[63] Continuation of Ser. No. 403,029, Jul. 29, 1982.

[51] Int. Cl.[4] ..... E04C 2/42

[52] U.S. Cl. ..... 52/584; 52/669; 52/664; 52/660; 52/177

[58] Field of Search ..... 52/584, 588, 669, 664, 52/660, 177, 180

[56] References Cited

U.S. PATENT DOCUMENTS

| | | | |
|---|---|---|---|
| 765,963 | 7/1904 | Evans | 52/588 |
| 792,451 | 6/1905 | Pruss | 52/238.1 |
| 1,076,017 | 10/1913 | Chase | 52/180 |
| 1,368,699 | 2/1921 | Collins | 52/355 |
| 1,946,035 | 2/1934 | Reuter | 52/180 |
| 2,101,952 | 12/1937 | Olsen | 52/242 |
| 2,112,949 | 4/1938 | Bunker | 52/669 |
| 2,123,931 | 7/1938 | Bunker | 52/650 |
| 2,128,753 | 8/1938 | Lienhard | 52/668 |
| 2,406,559 | 8/1946 | Oakes | 52/581 |
| 2,846,931 | 8/1958 | Priest | 52/669 |
| 3,083,620 | 4/1963 | Lorig | 52/180 |
| 3,093,216 | 6/1963 | Dunham | 52/180 |
| 3,369,337 | 2/1968 | Butler | 52/669 |
| 3,469,359 | 9/1969 | Nagin | 52/177 |
| 3,540,178 | 11/1970 | Altissimo | 52/669 |
| 3,653,172 | 4/1972 | Schwartz | 52/669 |
| 3,841,046 | 10/1974 | Scicchitano et al. | 52/650 |
| 3,956,788 | 5/1976 | Nagin | 52/664 |
| 4,037,383 | 7/1977 | Diebold et al. | 52/664 |
| 4,051,639 | 10/1977 | Lombardi et al. | 52/177 |
| 4,075,810 | 2/1978 | Zakrzewski et al. | 52/588 |
| 4,112,640 | 9/1978 | Reifsnyder | 52/177 |
| 4,198,795 | 4/1980 | Barnidge | 52/180 |

FOREIGN PATENT DOCUMENTS

| | | | |
|---|---|---|---|
| 207589 | 8/1956 | Australia | 52/664 |
| 1560097 | 3/1968 | France | 52/669 |
| 437239 | 10/1935 | United Kingdom | 52/664 |

*Primary Examiner*—Donald G. Kelly
*Assistant Examiner*—Michael Safavi
*Attorney, Agent, or Firm*—Kokjer, Kircher, Bradley, Wharton, Bowman & Johnson

[57] ABSTRACT

A plank grating assembly for forming decking, flooring or subflooring. Longitudinal metal planks have flanges on each side edge and trapezoidal openings in each flange. The planks are rigidly connected and supported by cross braces each having an inverted V shaped configuration. Each brace is slotted at both ends. The braces can be inserted through the openings in the plank flanges and then rotated to an assembled position in which the edges of adjacent openings are closely received in the slots of the braces.

12 Claims, 3 Drawing Figures

PLANK GRATING ASSEMBLY

This is a continuation of application Ser. No. 403,029 filed July 29, 1982.

BACKGROUND AND SUMMARY OF THE INVENTION

This invention relates to metal plank grating of the type used in the construction of flooring and subflooring and particularly in mezzanine decks that are erected in warehouses and other buildings.

The utilization of storage space in warehouses and similar buildings can often be made more effective by constructing a mezzanine level deck at a location intermediate the floor and ceiling of the building. The mezzanine provides added floor space at a convenient location that formerly served only as vacant overhead space. The mezzanine provides expansion space without the need to incur the high costs of new building construction.

The mezzanine structure is typically supported by horizontal beams that extend between upright support columns standing on the warehouse floor. Decking is installed on the horizontal beams to form the mezzanine floor. Connected metal planks, which can be either solid surfaces or gratings, are most often used to form the decking. Assembly of the decking normally involves the application of nuts and bolts, crimping of overlapped flanges or similar mechanical fasteners that require tools and the installation costs are relatively high due to the need to connect the planks together. Other problems with conventional plank grating is that the strength is now always sufficient to accommodate the heavy loads that can be applied to the mezzanine deck or to the conventional decks easily applicable for wheel use.

The present invention is directed to an improved plank grating assembly. It is the principal object of the invention to provide a plank grating arrangement which can be quickly and easily assembled, without the need for tools or mechanical fasteners, and which exhibits the strength required by accepted design criteria. Other objects of the invention include the provision of a plank grating assembly which is economical to manufacture, which readily accommodates wheeled goods on the deck surface, and which is constructed to utilize a variable number of cross braces so that different load capacities and concentrated loads can be handled. It is another important object of the invention to provide a plank grating assembly in which the loads are uniformly distributed and effectively transmitted to the main support beams.

In accordance with the invention, the decking is formed by longitudinal planks which are connected with one another and supported by cross braces each having the shape of an inverted V. The cross braces are slotted on both ends and are slipped through openings formed in side flanges of the longitudinal planks. The braces can be rotated into an assembled position in which they lock the flanges of adjacent planks together in order to rigidly connect the planks side by side to form a continuous deck surface. The braces are located immediately beneath the deck surface in order to receive and transmit the loads applied to the deck. The load bearing braces not only transmit loads from the planks to the support beams in an efficient and uniform manner, but they also rigidly connect adjacent planks without using male or female type flanges, without the need to install nuts and bolts or other special fasteners and without the need for crimping tools or other assembly equipment.

DETAILED DESCRIPTION OF THE INVENTION

In the accompanying drawings which form a part of the specification and are to be read in conjunction therewith and in which like reference numerals are used to indicate like parts in various views.

Figure 1:
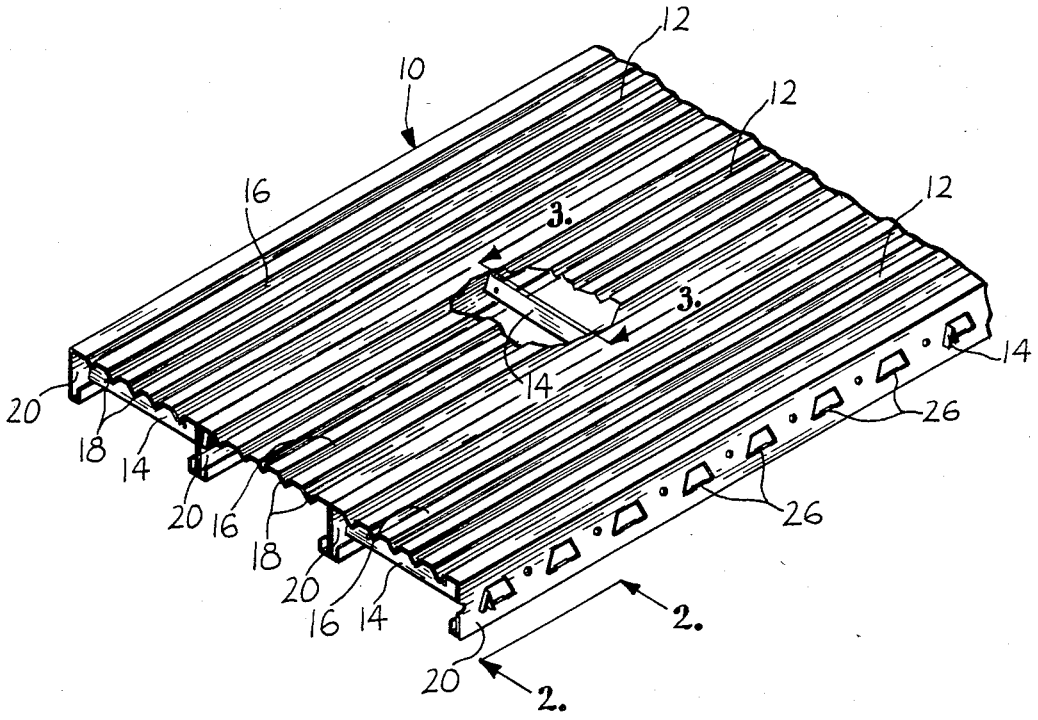
FIG. 1 is a fragmentary perspective view of a floor, subfloor or mezzanine deck constructed in accordance with the plank grating arrangement of the present invention, with a portion of the deck broken away for purposes of illustration.

Referring now to the drawings in more detail, the present invention provides plank grating which can be used to construct decking, flooring and/or subflooring. For purposes of illustration, a portion of a mezzanine deck 10 is shown in FIG. 1 in order to exemplify the types of decking or flooring that can be assembled by using the plank grating.

The plank grating assembly includes a plurality of metal planks 12 which are connected and supported by ties or braces 14. Both the planks 12 and braces 14 are constructed of steel, and they can be conveniently formed by continuous roll forming production techniques utilizing pre-coated coils of 18 gauge steel, for example.

Planks 12 can vary in length, although it is contemplated that each plank will be between 12 and 24 feet long. The width of each plank can also vary and is $11\frac{3}{4}$ inches in a preferred form of the invention. The body portion of each plank 12 provides a deck panel 16 having a series of longitudinal grooves 18 (which may help provide a roughened upper surface) therein to strengthen the deck panel and provide a non-skid surface. Each of the opposite side edges of the deck panel 16 is provided with a downturned side flange 20 having a height of $2\frac{1}{2}$ inches in the preferred form of the invention. Turned inwardly from the bottom edge of each flange 20 is a shorter horizontal flange 22 which is parallel to the deck panel 16. An upturned lip 24 is formed on the inside edge of each bottom flange 22 and should be dimensioned so that it will not touch cross brace 14.

Figure 2:
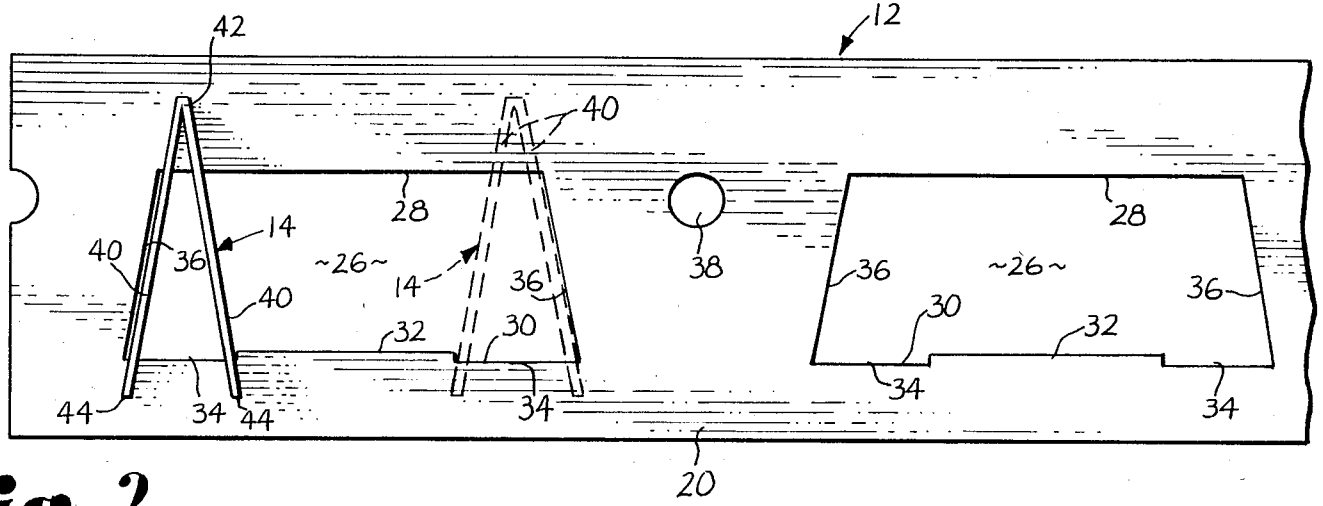
FIG. 2 is a fragmentary side elevational view of the deck on an enlarged scale taken generally along line 2—2 of FIG. 1 in the direction of the arrows.

As best shown in FIG. 2, each side flange 20 of each plank is provided with a plurality of spaced apart openings 26 each having a trapezoidal shape. The upper and lower edges 28 and 30 of each opening are generally parallel, although the bottom edge 30 is provided with a centrally located projection 32 which defines recessed areas 34 on either side of the projection. The side edges 36 of each opening 26 are inclined in opposite directions and converge slightly from bottom to top. In a preferred form of the invention, the lateral dimension between the center lines of the recessed areas 34 within each opening 26 is approximately 3 inches. The vertical dimension of each opening between the upper and lower edges 28 and 30 is about $1\frac{1}{4}$ inch. The length of projection 32 is $1\frac{1}{2}$ inches. Round holes 38 are punched between each pair of openings 26 to serve as guides for cutoff points and/or bolt holes if bolts are used to connect the planks.

As previously indicated, the braces 14 tie planks 12 together and receive the loads that are applied to the deck surface formed by the planks, ultimately transmitting the loads to the main support beams (not shown). Each brace 14 is about 12¼ inches long so that it can span plank 12 between the side flanges 20. As best shown in FIG. 2, each brace 14 is in the form of an inverted V in section and includes a pair of legs 40 which are connected with one another at an apex 42 of the brace. Opposite the apex 42, each leg 40 has a free edge 44. The edges 44 are spaced apart about ¾ inch in a preferred form of the invention. The height dimension of each brace 14 is about 2 inches.

Figure 3:
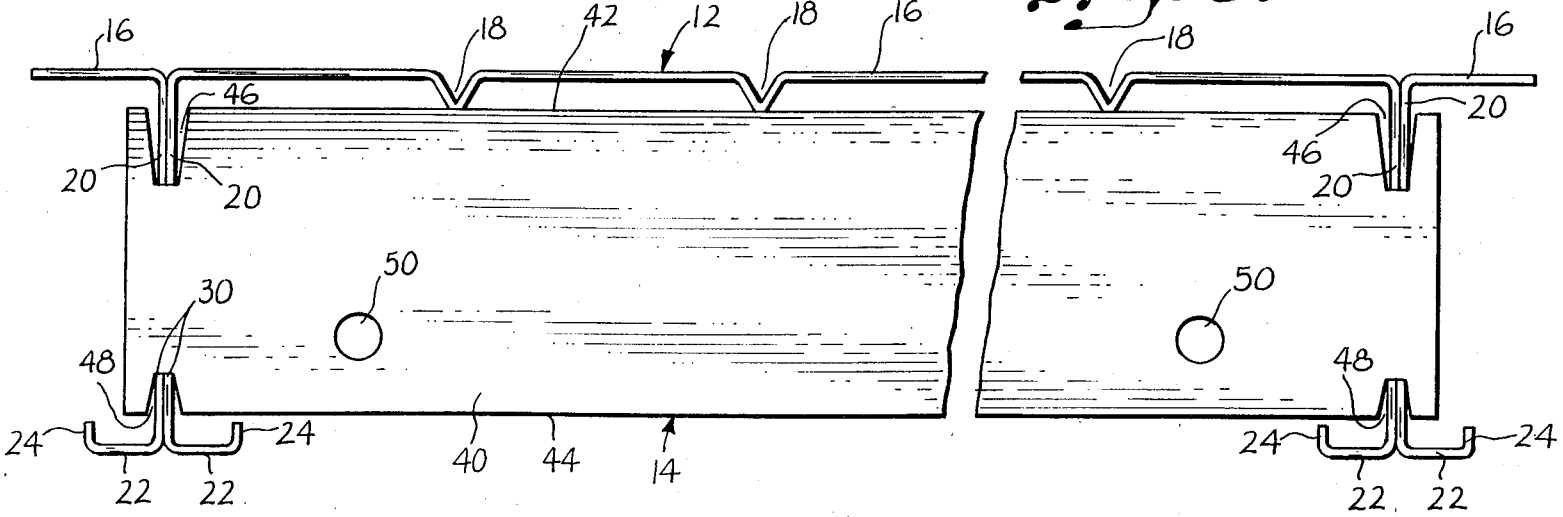
FIG. 3 is a fragmentary sectional view on an enlarged scale taken generally along line 3—3 of FIG. 1 in the direction of the arrows, with the broken away portions indicating continuous length.

With particular reference now to FIG. 3, each brace 14 is provided in its apex 42 with a pair of tapered slots 46 located near the opposite ends of the brace. Each slot 46 tapers as it extends downwardly from the top edge of the brace. Each slot terminates in a flat base portion having a width substantially equal to the combined thickness of two plank flanges 20. Accordingly, the upper edges 28 of two adjacent openings 26 fit closely in slot 46, as shown in FIG. 3.

The free edge 44 of each brace leg 40 is provided with a pair of tapered slots 48 located near the opposite ends of the legs. Slots 48 are not as deep as slots 46. Slots 48 taper as they extend upwardly into the legs, and each slot terminates in a flat base portion equal in width to the combined thickness of two flanges 20. The lower edges 30 of adjacent openings 26 thus fit closely in slot 48 in the manner shown in FIG. 3.

Each leg 40 of each brace 14 is provided with a series of holes 50 which permit the assembled plank grating structure to be tied down to its supporting structure (not shown); or it may serve as a passageway for conduit to assist light fixture installers.

In order to assemble the planks 12 for the formation of the mezzanine deck 10, each plank is positioned side by side with an adjacent plank such that the adjacent flanges 20 are disposed flatly against one another, as shown in FIG. 3. The openings 26 in the adjacent flanges are aligned with one another and with the openings in the flanges on the opposite sides of the planks. With the planks so positioned, a brace 14 is inserted through the aligned opening with the brace positioned sideways such that its height dimension is oriented parallel to the lateral dimension of the openings. Since the openings are each greater than 3 inches wide and the height of each brace is 2 inches, the brace can be easily fitted through the openings in this orientation to span the opposite flanges of the selected plank 12. When slots 46 and 48 are disposed in the same plane as the upper and lower edges 28 and 30 of the openings, the brace is rotated through 90° to the assembled position in FIG. 2 wherein the height dimension of the brace is oriented parallel with the vertical dimension of the opening. The upper edges 28 of adjacent openings 26 then fit closely in the upper slot 46, while the adjacent lower edges 30 fit closely in the lower slot 48. The slots 46 and 48 on the opposite end of the brace receive another pair of upper and lower edges, unless the plank extends along one side of the deck. Then, only one upper edge 28 and one lower edge 30 are received in the slots 46 and 48.

In the assembled position, the apex 42 of each brace extends immediately beneath the deck panel 16 to provide bracing and support. The free edges 44 of the brace legs 40 rest on top of the lips 24 to provide further stability. The distance between the base portions of slots 46 and 48 is equal to the vertical dimension of opening 26 so that a close fit is achieved. The side edges 36 of openings 26 are inclined in conformity with the incline of the brace legs 40. Consequently, when one of the braces is in the assembled position adjacent to one of the side edges 36, the adjacent leg 40 is positioned adjacent to the side edge of the opening as shown in FIG. 2. The legs 40 span recesses 34 and fit closely therein to resist any tendency for the legs (40) to unduly spread apart when loads are applied to the decking. In this manner, the brace is firmly held in position to connect and support the planks. The assembled plank grating can be mounted in any suitable manner to conventional mezzanine support beams.

When applied in this manner to the longitudinal planks 12, the cross braces 14 are oriented transversely to the planks and are rigidly interlocked therewith. The braces serve to rigidly connect the adjacent planks together side by side in order to provide a continuous deck surface for the mezzanine or flooring formed by the plank grating. At the same time, the braces receive the loads that are applied to the planks and transmit the loads in a uniform manner from the planks to the support beams (not shown).

It is noted that the number of braces that are utilized per linear foot of planking can be varied as desired, depending upon the load requirements. The braces 14 can be spaced rather widely, or they can be installed in each opening. It is an important feature of the invention that two of the braces can be installed in one opening 26. After the first brace has been assembled as shown in solid lines in FIG. 2, the second brace is inserted through the openings with its height dimension oriented parallel to the lateral dimension of the opening. The second brace can then be rotated 90° to the assembled position shown in broken lines in FIG. 2. This also permits the cross braces to be installed as close as 3 inches in adjacent planks using same opening 26. Thus, if heavy loads are to be applied to the decking, or if particularly strong bracing is needed at the ends of planks or at splices between planks, it is possible to provide two braces for each of the openings 26. More commonly, the braces will be spaced more widely apart such as at two or three foot intervals.

When fully assembled, the interlocked planks 12 and braces 14 transmit the applied loads throughout all of the panels in a uniform and efficient manner in all directions. The positive and negative forces interact between the adjacent support beams (not shown). Installation requires neither tools nor mechanical fasteners such as nuts and bolts, and the male-female configuration on the lower end of each side flange 20 permits the planks to be interchanged and/or reversed. The joints between plank ends will normally be staggered (such as on 6 inch centers) and do not need to be located over the main support beams.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claim.

Since many possible embodiments may be made of the invention without departing from the scope thereof, it is to be understood that all matter herein set forth or shown in the accompanying drawings is to be interpreted as illustrative and not in a limiting sense.

I claim:

1. A plank grating arrangement comprising:

a plurality of elongate planks each having a deck panel and flanges on opposite sides of each panel, said planks being adapted to be arranged side by side with the panels cooperating to form a substantially continuous load bearing deck surface and with flanges of adjacent planks being disposed against one another;

a plurality of spaced apart openings in the flanges of each plank, each opening having a lateral dimension defined between side edges of the opening and a vertical dimension defined between upper and lower edges of the opening; and a plurality of removable braces each long enough to span the flanges of each plank and each having opposite end portions presenting slot means therein, each brace being insertable through aligned openings in the plank flanges with a heat dimension of the brace oriented generally parallel to the lateral dimensions of the openings and being thereafter rotatable in the openings to an assembled position wherein the height dimension of the brace is oriented generally parallel to the vertical dimensions of the openings and said upper and lower edges of the openings in adjacent flanges fit closely in said slot means to rigidly connect the planks together for formation of the load bearing deck surface with the braces immediately underlying and in contact with the deck panels to receive loads applied thereto and the adjacent flanges of the planks held together in contact with one another by the fit of said upper and lower edges of the openings in said slot means, said braces being removable from said slot means.

2. The invention of claim 1, wherein said slot means comprises a plurality of slots each having a tapered configuration and terminating in a base portion having a width to closely receive a pair of adjacent edges of the openings in adjacent flanges.

3. The invention of claim 1, wherein each brace has the general shape of an inverted V in section and includes a pair of legs joined at an apex, each leg being inclined from vertical and each apex immediately underlying the corresponding deck panel in the assembled position of the brace.

4. The invention of claim 3, wherein the side edges of the openings are inclined at substantially the same angle as the legs of the braces when the braces are in the assembled position, one leg of each brace being located adjacent one side edge of each opening through which the brace extends in the assembled position.

5. The invention of claim 3, including means associated with each opening for retaining the legs of the braces against spreading apart in the assembled position.

6. The invention of claim 3, wherein said slot means includes:

a slot in the apex of each brace near each end thereof for receiving the upper edges of the openings in the assembled position of the brace; and a slot in a free edge of each leg near each end thereof for receiving the lower edges of the openings in the assembled position of the brace.

7. The invention of claim 1, wherein the lateral dimension of each opening is sufficient to receive one of the braces with the height dimension thereof oriented generally parallel to the lateral dimension of the opening while another brace is in the assembled position in the opening, whereby a pair of braces can be arranged in the assembled position in each opening.

8. A plank grating assembly comprising:

a plurality of elongate metal planks each having a deck panel and flanges on opposite sides of each panel, said planks being adapted to be positioned side by side with the panels cooperating to form a substantially continuous load bearing deck surface and with flanges of adjacent panels being disposed in contact with one another;

a plurality of spaced apart openings in the flanges of each plank, each opening having a lateral dimension defined between said edges of the opening and a vertical dimension defined between upper and lower edges of the opening;

a plurality of braces each having the general shape of an inverted V in section with a pair of legs joined at an apex and terminating opposite the apex in free edges, each brace being of sufficient length to span the plank width between said flanges and each brace being insertable through aligned openings with a height dimension of the brace offset from a parallel relationship with the vertical dimensions of the openings; and a pair of slots in each free edge near opposite ends thereof and a pair of slots in each apex near opposite ends thereof, each brace being rotatable in aligned openings to an assembled position wherein the height dimension of the brace is generally parallel to the vertical dimensions of the openings, said slots being arranged such that wen each brace is rotated to the assembled position the lower edges of adjacent openings fit closely in the slots in the free edges of the brace legs and the upper edges of adjacent openings fit closely in the slot, thereby rigidly connecting the planks for formation of the load bearing deck surface with the braces immediately underlying and in contact with the deck panels to receive and distribute loads applied thereto, said braces being removable from said slots.

9. The invention of claim 8, wherein:

each opening is generally trapezoidal in shape with generally parallel upper and lower edges and non-parallel side edges; and each side edge is inclined at an angle substantially equal to the inclined angle of a brace leg positioned in the opening adjacent the side edge in the assembled position of the brace.

10. The invention of claim 9, including means on the lower edge of each opening for resisting spreading apart of the legs of a brace positioned in the opening in the assembled position.

11. The invention of claim 9, wherein the lateral dimension of each opening is sufficient to permit insertion of a second brace in the opening and rotation of the second brace to the assembled position adjacent one side edge of the opening while a first brace is in the assembled position adjacent the other side edge of the opening.

12. The invention of claim 11, including a projection on the lower edge of each opening engageable with one leg of each of the first and second braces to resist spreading apart of the legs of each brace in the assembled position.

* * * * *